United States Patent [19]

Mahnad

[11] Patent Number: 4,668,956

[45] Date of Patent: May 26, 1987

[54] BROADBAND CUP ANTENNAS

[75] Inventor: Ali R. Mahnad, Sacramento, Calif.

[73] Assignee: Jampro Antennas, Inc., Sacramento, Calif.

[21] Appl. No.: 722,597

[22] Filed: Apr. 12, 1985

[51] Int. Cl.[4] ..... H01Q 1/36; H01Q 21/26

[52] U.S. Cl. ..... 343/789; 343/895

[58] Field of Search ..... 343/796, 797, 798, 895, 343/789

[56] References Cited

U.S. PATENT DOCUMENTS

| | | | |
|---|---|---|---|
| 3,745,585 | 7/1973 | Barbano | 343/895 |
| 4,042,935 | 8/1977 | Ajioka et al. | 343/797 |
| 4,218,685 | 8/1980 | Frosch | 343/797 |

*Primary Examiner*—Eli Lieberman

*Attorney, Agent, or Firm*—Flehr, Hohbach, Test, Albritton & Herbert

[57] ABSTRACT

A broadband cup antenna comprises dipole means having at least one pair of short spiral type monopoles diametrically disposed in a common plane in proximity to the open end of the cup. Parasitic elements are in juxtaposition with the monopoles and are electrically connected by a conductive ring mounted about coaxial lines. A circumferential slot formed in the outer conductor of the coaxial line adjacent to the monopoles serves for excitation of the monopole elements to effectuate signal transmission.

9 Claims, 9 Drawing Figures

BROADBAND CUP ANTENNAS

TECHNICAL FIELD

This invention relates to broadband cup antennas and in particular to broadband cup-dipole and cup turnstile antennas.

BACKGROUND OF THE INVENTION

Broadband cup dipole antennas are generally well known for generating uniform radiation patterns in the electric (E) and magnetic (H) planes.

One problem with prior art broadband cup antennas, which use large elements for the monopoles, is that the relatively large size of the monopoles brings the edges of the monopoles close to the cup walls, such that the radiation pattern is not easily controllable. An antenna of this type is described in IEEE Transactions on Broadcasting, Vol. BC-22, No. 3, September 1976, pages 91–96, in an article entitled "A New CP Antenna for Television Broadcast Service." Also, prior art antennas generally require a center tapped transformer to transform an unbalanced feed to a balanced feed.

One type of cup antenna is the cup turnstile, which has a pair of dipoles that provide circularly polarized radiation that is distributed substantially uniformly in all directions. U.S. Pat. No. 3,740,754 describes a cup turnstile antenna having a pair of dipoles formed from four tubular rods serving as monopoles. The patent describes an antenna in which a feed line is passed through an impedance transformer to provide a separate coaxial line for each monopole. The patent is directed to an implementation of an antenna having a pair of dipoles and a pair of feed lines which are coupled to a pair of transformers. Separate coaxial lines are connected to each of the four monopoles and to two transformers for exciting the monopole elements. The transformers are needed to transform an unbalanced input signal to a balanced output signal. Also the transformer serves to provide the reactance needed to realize broadband operation.

SUMMARY OF THE INVENTION

An object of this invention is to provide an improved broadband cup antenna which provides a broad bandwidth radiation signal and in which the radiation pattern is controllable.

In accordance with this invention, a broadband cup antenna comprises at least one pair of diametrically spaced flat monopoles having a short spiral type configuration positioned near the mouth of the cup. Parasitic elements having a similar short spiral type configuration are disposed adjacent to the monopoles, and are electrically connected to a conductive ring. The monopoles are electrically connected to the outer conductor of a coaxial line which is coupled to a transmitter for signal transmission. A circumferential slot or hiatus is provided in the outer conductor of the coaxial line adjacent to the monopoles for energizing the monopoles.

BRIEF DESCRIPTION OF THE DRAWINGS

The invention will be described with reference to the drawings in which.

Similar numerals refer to similar elements throughout the drawings.

DESCRIPTION OF THE PREFERRED EMBODIMENTS

Figure 1:
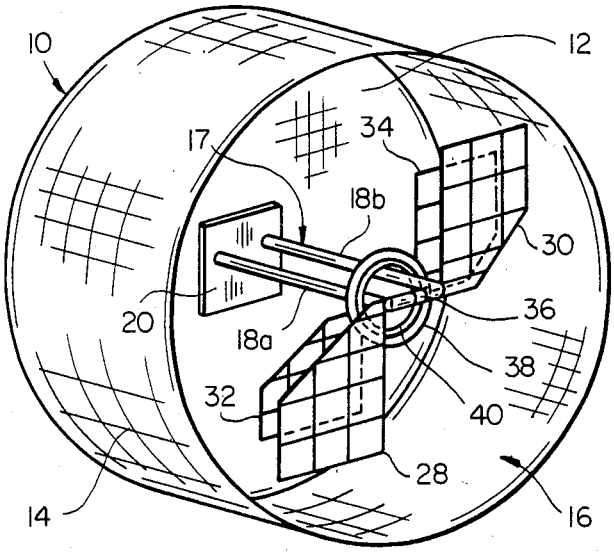
FIG. 1 is an isometric view of a broadband cup antenna, made in accordance with this invention.
Figure 2:
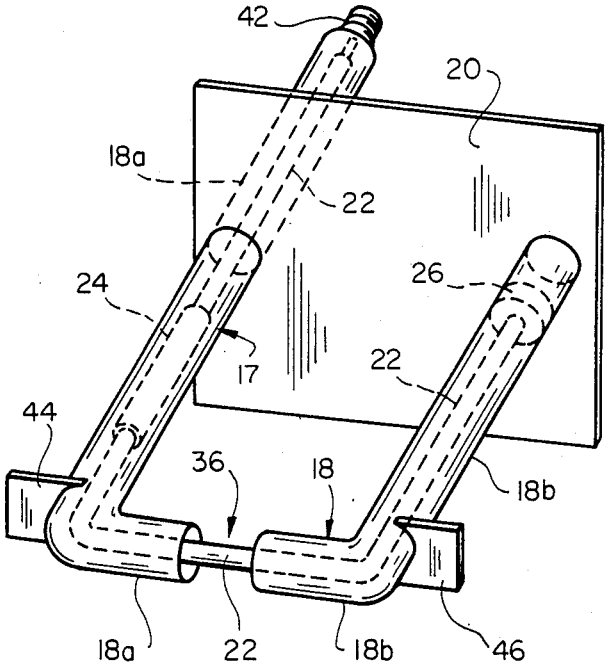
FIG. 2 is a front enlarged view of a portion of the apparatus of FIG. 1, depicting the coaxial feed.
Figure 3:
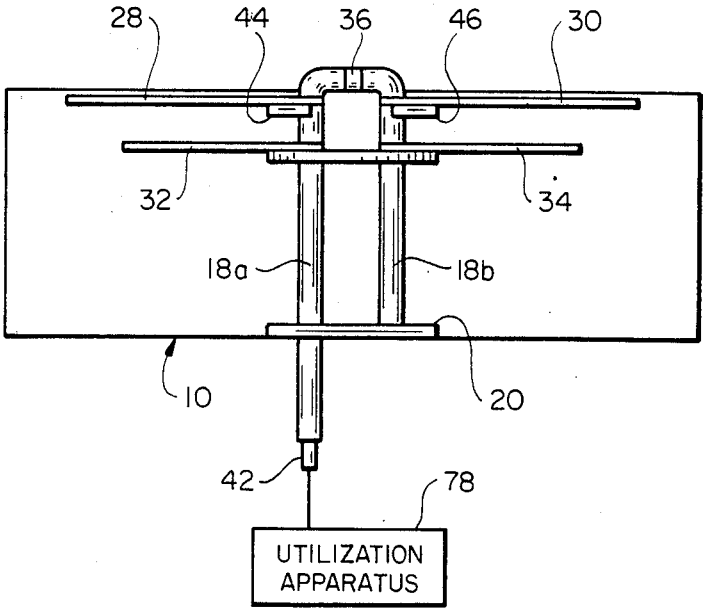
FIG. 3 is a top representational view, partly in block form, of the apparatus of FIG. 1.

With reference to FIGS. 1–3, a broadband cup antenna includes a cylindrical cup 10 made preferably of a conductive wire mesh. The wires are spaced at predetermined intervals which are determined by the wavelength of the signal to be transmitted or received. The cup has a bottom section 12, a cylindrical side section or wall 14, and an open end or mouth 16 opposing the bottom section.

Within the cup 10, a coaxial feed line 17, which is formed substantially in a U-shape, is rigidly supported by a conductive plate 20 fixed at the bottom of the cup. The coaxial line 17 comprises an outer conductor 18, which may be a copper or steel pipe. The outer conductor may consist of an external conductive pipe and a separate coaxial outer conductor in contact with the pipe. The coaxial line includes a continuous inner conductor 22. A conductive fine tuning element 24 encompasses a portion of one leg of the inner conductor 22.

In accordance with one feature of this invention, the outer conductor 18 is characterized by a circumferential slot or hiatus 36, which in effect splits the outer conductor into L-shaped sections **18*a* and 18*b*. The slot is located centrally and closely adjacent to a pair of flat monopoles 28 and 30, which are disposed diametrically in the same plane within the cup and close to the plane defined by the rim of the open end of the cup. Each of the monopoles is connected at one end respectively to an outer conductor section 18*a* and 18*b*. The monopoles are formed in a short spiral pattern, in accordance with this invention, to realize a sufficient spacing from the cylindrical wall 14** of the cup, thereby affording a substantial improvement in control of the radiation pattern and the bandwidth. Each monopole is formed substantially with a rectangular section and a triangular type or angled section having an end that is electrically connected to the coaxial line.

The coaxial line 17 passes through two spaced apertures in the plate 20 and has a feed line termination 42, shown in FIG. 2. An annular shorting part 26, made of brass for example, is positioned at one point between the inner conductor 22 and outer conductor **18*b*. Conductive connecting parts 44 and 46 attach the monopoles 28 and 30** to the outer conductors.

A pair of parasitic elements 32 and 34, made of a similar conductive wire mesh as the monopoles, are positioned below the monopoles and closely adjacent thereto. The elements 32 and 34 are also formed in a substantially short spiral pattern, and serve as capacitor elements providing an inverse reactance which is added to the reactance of the monopoles to achieve broadband operation. The parasitic elements 32 and 34 are connected to a conductive ring 38 which is disposed about the outer conductors of coaxial line 17. The conductive ring is electrically and physically connected to the inner ends of the conductive parasitic elements. An insulating material 40, such as Teflon, is disposed between the conductive ring 36 and the parallel legs 18*a* and 18*b* of the conductive coaxial line 17.

During operation, when the antenna is used for transmission, the feed signal is applied to the termination feed line external to the cup bottom. The signal traverses the coaxial line and an excitation signal is generated at the circumferential slot 36 which is applied to the adjacent monopoles. A controlled radiation signal is developed, having a substantially uniform pattern over a broadband of signal frequency, and applied to a utilization apparatus 78, such as a transmitter.

Figure 4:
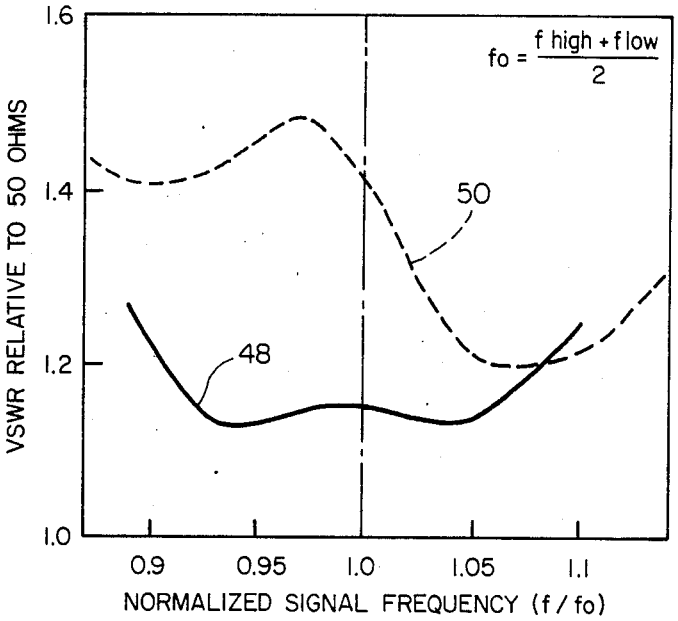
FIG. 4 is a plot showing the voltage standing wave ratio (VSWR) relative to 50 ohms plotted against normalized signal frequency, for the antenna of this invention in comparison with prior art antenna.

As illustrated in FIG. 4, the plot of the VSWR relative to a 50 ohms coaxial line versus the normalized signal frequency $f/f_o$, $$\left(\text{where } f_o \text{ equals } \frac{f_{high} + f_{low}}{2}\right),$$

shows in solid curve 48 the operating characteristic of an antenna made in accordance with this invention. It is noticeably more flat, particularly in the frequency bandwidth of interest, than the curve 50 associated with prior art antennas of the cup-dipole type. The frequency range of interest in this case is 0.9 $f_o$ MHz to 1.1 $f_o$ MHz. This significant improvement in performance is attributed to the short spiral configuration of the flat monopoles and the circumferential slot, among other things.

Figure 5:
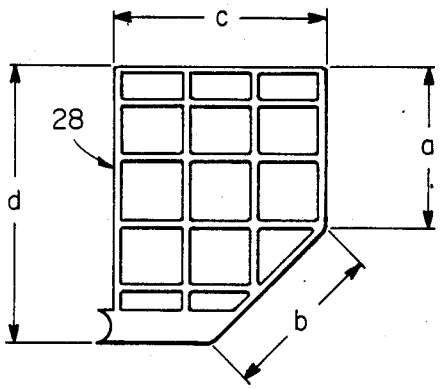
FIG. 5 is an enlarged view of a monopole as used with this invention.
Figure 6:
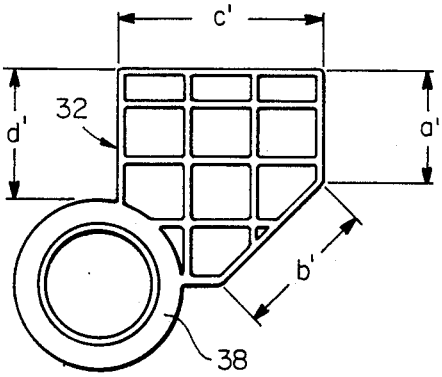
FIG. 6 is an enlarged view of a parasitic element and conductive ring as used in this invention.

With reference to FIGS. 5 and 6, the relative dimensions of the monopoles and the parasitic elements, in a preferred implementation, are designed by ratios for $$\frac{a'}{a} = 0.8; \frac{b'}{b} = 0.83; \frac{c'}{c} = 0.86, \text{ and } \frac{d'}{d} = 0.46.$$

The diameter of the conductive ring 38 in FIG. 6 is approximately 8% larger than the linear c' dimension. It should be understood that the absolute dimensions and geometries of the monopoles and parasitic elements are dependent upon the cup size and diameter. The variations in the VSWR is much more pronounced for the prior art antenna as is readily apparent.

It is noted that by virtue of the apparatus of this invention, the average value of the impedance, which is measured directly at the dipole terminals, over a broad frequency range of approximately 20% is inherently close to the characteristic impedance of the types of transmission lines that are mostly used, i.e., those that employ a 50 ohm coaxial line. One apparent advantage of this invention is that there is no requirement for a transformer when the antenna is fed by a 50 ohm transmission line, as is generally required for prior art cup-dipole antennas.

Figure 9:
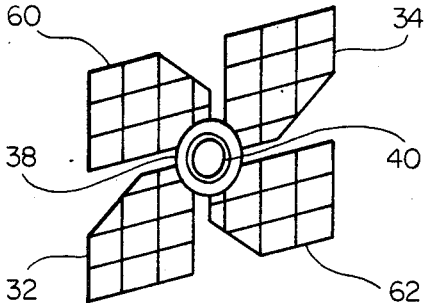
FIG. 9 is a schematic view showing the parasitic elements and conductive ring of FIG. 7.
Figure 7:
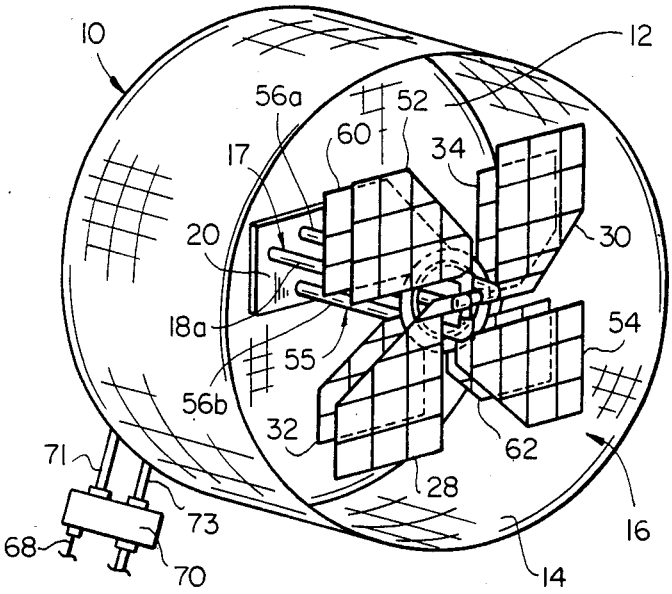
FIG. 7 is an isometric view of a broadband cup dipole and cup turnstile antenna, made in accordance with this invention.
Figure 8:
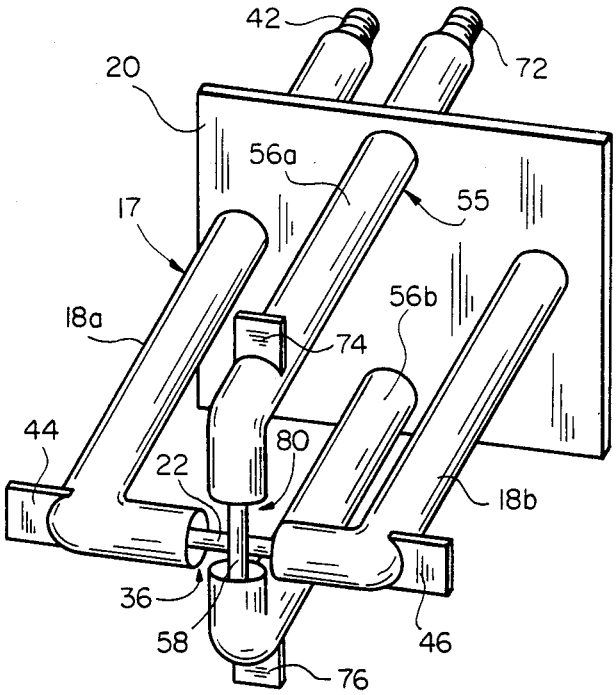
FIG. 8 is a front enlarged view of a portion of the apparatus of FIG. 7.

Another embodiment of this invention is illustrated in FIGS. 7–9, wherein a cup turnstile antenna has a pair of dipoles formed respectively with four monopoles 28 and 30, and 52 and 54.

Four parasitic elements 32, 34 and 60, 62 are provided, as depicted in FIG. 9 in juxtaposition with the monopoles to enhance broadband operation. The axis of the dipoles are at right angles to each other and disposed in a common plane close to that defined by the open end 16 of the cylindrical cup 10. The monopole elements 28 and 30 that form one dipole are mechanically and electrically connected to the outer conductors 18*a* and 18*b* respectively, as described with reference to FIG. 1. In this implementation of a cup-turnstile antenna, additional monopole elements 52 and 54, which form the second dipole, are connected electrically to outer conductors 56*a* and 56*b* respectively. In addition to the centrally located circumferential slot 36, a second circumferential slot 80 is provided.

As illustrated in FIG. 8, an additional feed line 72 is supplied for the coaxial line 55 constituting the coaxial outer conductors 56*a* and 56*b* and inner conductor 58, which are spaced at 90° intervals from the conductors of coaxial line 17. The monopoles are connected through conductive elements 44, 46 and 74, 76. A shorting element (not shown) similar to the shorting element 26 shown in FIG. 2 is also provided for the coaxial line 55. The two dipoles are connected to a utilization apparatus through an input coaxial line via a quadrature hybrid coupler 70 having two output lines 71 and 73 connected to the feed lines 42 and 72. A decoupling input port 68 is connected either to a matched termination or a second utilization apparatus. The cup turnstile antenna affords a controllable uniform circularly polarized radiation pattern.

By virtue of this invention, a cup dipole antenna and cup turnstile antenna are constructed without the need for impedance transformers for splitting coaxial lines to provide a balanced output from an unbalanced input. The balancing occurs within the antenna cup as a result of the novel assembly. The radiation patterns obtained with the antennas disclosed herein are relatively uniform and controllable. The configuration of the cup turnstile antenna also minimizes the cross-coupling effect between the coaxial lines. The short spiral type design of the monopoles effectively expands the bandwidth of the cup-dipole antennas, and the parasitic elements substantially improve the bandwidth.

What is claimed is:

1. A broadband cup-dipole antenna comprising:

a conductive cylindrical cup having a bottom wall and an oppositng open end delineated by a cylindrical rim;

dipole means comprising at least one pair of monopoles;

parasitic elements for providing a reactance positioned within said cup and located between said pair of monopoles and said bottom wall;

a coaxial line having inner and outer conductors; and a conductive ring positioned about said coaxial line, said rings being connected to said parasitic elements.

2. A broadband antenna as in claim 1, wherein said monopoles are formed in a short spiral type configuration.

3. A broadband antenna as in claim 1, wherein said monopoles and parasitic elements are flat and are disposed in a common plane.

4. A broadband antenna as in claim 1, wherein said conductive cup is made of a mesh of conductive wires.

5. A broadband antenna as in claim 1, wherein said monopoles are electrically connected to said outer conductor.

6. A broadband antenna as in claim 1, including a circumferential gap formed in said outer conductor adjacent to said monopoles.

7. A broadband antenna as in claim 1, including an electrical shorting part for shorting said outer conductor at one point to said inner conductor.

8. A broadband cup-dipole antenna comprising:

a conductive cylindrical cup having a bottom wall and an opposing open end delineated by a cylindrical rim;

dipole means comprising at least one pair of monopoles;

parasitic elements for providing a reactance positioned within said cup and located between said pair of monopoles and said bottom wall;

said dipole means comprising four monopoles spaced at 90° intervals in a common plane, including four parasitic elements, and each of said parasitic elements being aligned respectively with each of said monopoles in a direction parallel to the cylindrical axis of said cup.

9. A broadband antenna as in claim 8, including two coaxial lines associated with said four monopoles, said coaxial lines extending from said bottom wall and disposed orthogonally to each other, said coaxial lines including outer conductors and inner conductors, and two circumferential gaps formed in said outer conductors at right angles to each other.

* * * * *